US006504511B2

(12) United States Patent
Andersson

(10) Patent No.: US 6,504,511 B2
(45) Date of Patent: Jan. 7, 2003

(54) MULTI-BAND ANTENNA FOR USE IN A PORTABLE TELECOMMUNICATIONS APPARATUS

(75) Inventor: Johan Andersson, Malmo (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/835,910

(22) Filed: Apr. 16, 2001

(65) Prior Publication Data

US 2001/0030627 A1 Oct. 18, 2001

(30) Foreign Application Priority Data

Apr. 18, 2000 (SE) ..... 000-1432

(51) Int. Cl.[7] ..... H01Q 1/24; H01Q 9/04
(52) U.S. Cl. ..... 343/702; 343/700 MS
(58) Field of Search ..... 343/703, 700 MS, 343/895, 725, 729, 853; 455/90

(56) References Cited

U.S. PATENT DOCUMENTS

| | | | | |
|---|---|---|---|---|
| 5,668,557 A | | 9/1997 | Kawahata | 343/700 MS |
| 6,011,524 A | * | 1/2000 | Jervis | 343/895 |
| 6,114,999 A | * | 9/2000 | Cassel et al. | 343/702 |
| 6,188,364 B1 | * | 2/2001 | Scordilis | 343/702 |

FOREIGN PATENT DOCUMENTS

| | | | |
|---|---|---|---|
| DE | 19857819 | A1 | 6/1999 |
| EP | 0 863 570 | A2 | 9/1998 |
| EP | 0 923 158 | A2 | 6/1999 |
| JP | 5347507 | A | 12/1993 |
| WO | 97/18600 | | 5/1997 |
| WO | 99/03168 | A1 | 1/1999 |
| WO | 99/25043 | | 5/1999 |
| WO | 00/57511 | A1 | 9/2000 |

* cited by examiner

*Primary Examiner*—Don Wong
*Assistant Examiner*—James Clinger
(74) *Attorney, Agent, or Firm*—Burns, Doane, Swecker & Mathis, L.L.P.

(57) ABSTRACT

A multi-band antenna for use in a portable telecommunication apparatus has a pattern of thin conductive material and is adapted to operate in at least two, preferably at least three, frequency bands, such as 900 MHz, 1800 MHz and 1900 MHz. A first portion of conductive material has a first end, which is connected to radio circuitry in the portable telecommunication apparatus. It also has a second end. A second portion of conductive material has a first end, which in connected to the second end of the first portion. The second portion has a non-linear extension and is narrower than the first portion. A third portion of conductive material is connected to the second portion. The third portion is wider than the second portion and provides capacitive loading of the antenna.

18 Claims, 9 Drawing Sheets

Markers: 1: 33.453 Ω
56.168 Ω
880.000 MHz
2: 74.023 Ω
177.390 Ω
960.000 MHz
3: 29.954 Ω
-12.367 Ω
1 710.000 MHz
4: 54.992 Ω
19.410 Ω
1 990.000 MHz
5: 89.559 Ω
30.512 Ω
2 480.000 MHz Markers: 1: 4.5671
880.000 MHz
2: 10.582
960.000 MHz
3: 1.8216
1 710.000 MHz
4: 1.4623
1 990.000 MHz
5: 2.0753
2 480.000 MHz Markers: 1: 25.328 Ω
-1.5957Ω
879.500 MHz 2: 43.305 Ω
37.049 Ω
960.000 MHz 3: 18.764 Ω
-16.178 Ω
1 710.000 MHz 4: 32.623 Ω
5.7930 Ω
1 990.000 MHz 5: 72.773 Ω
10.453 Ω
2 450.000 MHz Markers: 1: 12.281 Ω
-19.661Ω
879.500 MHz
2: 104.22 Ω
30.324 Ω
960.000 MHz
3: 21.856 Ω
-4.4727 Ω
1 710.000 MHz
4: 42.891 Ω
-14.225Ω
1 990.000 MHz
5: 5.7900 Ω
-14.761 Ω
2 450.000 MHz Markers: 1: 4.7463
879.500 MHz
2: 2.3475
960.000 MHz
3: 2.3099
1 710.000 MHz
4: 1.4074
1 990.000 MHz
5: 9.3970
2 450.000 MHz Markers: 1: 14.894 Ω
-21.598 Ω
879.500 MHz 2: 22.705 Ω
1.1611 Ω
960.000 MHz 3: 34.449 Ω
5.6270 Ω
1 710.000 MHz 4: 72.355 Ω
-18.676 Ω
1 990.000 MHz 5: 26.563 Ω
-50.406 Ω
2 450.000 MHz

MULTI-BAND ANTENNA FOR USE IN A PORTABLE TELECOMMUNICATIONS APPARATUS

Generally speaking, the present invention relates to antennas for portable telecommunication apparatuses, such as mobile telephones. More particularly, the invention relates to a multi-band antenna, comprising a pattern of thin conductive material, which is adapted to operate in a least two frequency bands.

PRIOR ART

A portable telecommunication apparatus, such as a mobile telephone, requires some form of antenna in order to establish and maintain a wireless radiolink to another unit in the telecommunications system, normally a radio base station. Some years ago, many mobile telephones were provided with retractable whip antennas or non-retractable stub or helix antennas. More recently, other antenna types have been developed, which comprise a pattern of thin conductive material, usually copper, that is printed on a flexible dielectric substrate and is mounted on a suitable portion of the mobile telephone.

WO99/25043 discloses an antenna, which comprises a printed pattern of conductive material to be mounted on a flip, that is pivotally mounted to the main apparatus housing of the telephone. The printed antenna pattern comprises a meander-shaped portion, which acts as the actual antenna, and a spiral-shaped portion, which acts as an impedance matching network. On an opposite side of the flip a ground patch element is provided in alignment with the spiral-shaped impedance matching portion of the printed pattern.

EP-A2-0 923 158 discloses a dual-band antenna of a similar type. A radiating element with a meander form is printed on a first surface of a dielectric plate. On an opposite surface of the dielectric plate there is provided a planar parasitic element, which in some embodiments may operate as a separate radiator, thereby providing the antenna with the ability of operating in three frequency ranges. The antenna of EP-A2-0 923 158 is particularly adapted for mounting on the back wall of a mobile telephone.

SUMMARY OF THE INVENTION

It is a primary object of the present invention to provide a substantial improvement over previously known antennas of the type having a pattern of thin conductive material and being adapted to operate in more than one frequency band. More specifically, it is an object of the invention to provide an antenna, which is small, flexible and has good performance not only in a low frequency band, such as the 900 MHz GSM band, but also good performance in higher frequency bands, such as the 1800 MHz GSM or DCS band as well as the 1900 MHz GSM or PCS band.

An additional object is to provide an antenna, which may be formed as an integral pattern of conductive material, arranged in essentially a single plane, without requiring a separate parasitic or patch element for impedance matching purposes.

Still an object of the invention is to provide an antenna, which does not require a well-defined electrical ground.

Yet another object is to provide an antenna, which i inexpensive to manufacture.

Finally, another object is to provide an antenna, which may be embedded in a flexible plastic or rubber coating, which may be attached to an external portion of the mobile telephone and which may be bent, within reasonable limits, without damaging the antenna.

The objects above are achieved by a multi-band antenna according to the attached independent claim. More specifically, the objects are achieved for a multi-band antenna of the type comprising a pattern of thin conductive material, which is adapted to operate in at least two, preferably at least three, frequency bands, by the provision of a first portion of conductive material adapted to be connected to radio circuitry in a portable telecommunication apparatus, and a second portion of conductive material, which is connected to the first portion of conductive material, has a non-linear extension and is narrower than the first portion.

According to a preferred embodiment, the above objects are moreover achieved by providing the multi-antenna with a third portion of conductive material, which is connected to the second portion, is wider than the second portion and provides capacitive loading of the antenna.

Other objects, features and advantages of the present invention will appear from the following detailed disclosure of preferred and alternative embodiments, from the enclosed drawings as well as from the subclaims.

BRIEF DESCRIPTION OF THE DRAWINGS

Preferred and alternative embodiments of the present invention will now be described in more detail with reference to the enclosed drawings, in which.

DETAILED DESCRIPTION

Figure 1:
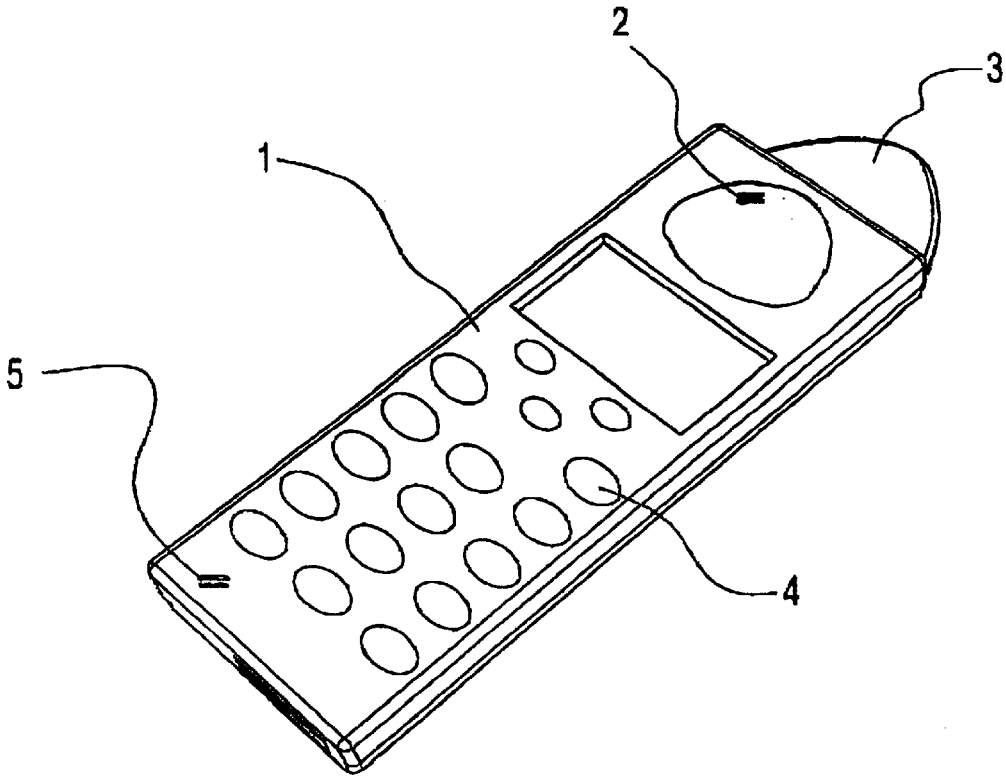
FIG. 1 is a schematic perspective view of a portable telecommunication apparatus, in the form of a mobile telephone, according to one aspect of the invention.
Figure 2:
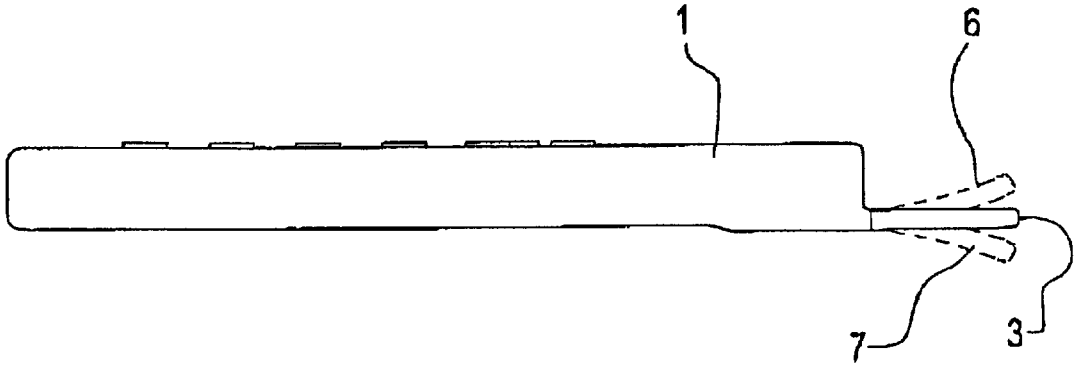
FIG. 2 is a side view of the mobile telephone shown in FIG. 1.

FIGS. 1 and 2 illustrate a mobile telephone 1 as one example of a portable telecommunication apparatus, in which the antenna according to the invention may be used. However, the inventive antenna may be used in virtually any other portable communication apparatus, which has to operate in at least two, preferably at least three, frequency bands.

The mobile telephone 1 shown in FIGS. 1 and 2 comprises a loudspeaker 2, a keypad 4, a microphone 5 and a display, as is generally known in the art. Moreover, the mobile telephone 1 comprises a flexible plastic or rubber coating 3, which is mounted on top of the apparatus housing of the mobile telephone 1. The antenna according to the invention is embedded inside this coating, as will be further explained below. As shown particularly in FIG. 2, the plastic or rubber coating 3 is flexible (as indicated by reference numerals 6 and 7), so that the antenna coating 3 may be bent, within reasonable limits, without damaging the antenna inside the coating. Obviously, this provides a great advantage as compared to conventional mobile telephones of the type having either a retractable whip antenna or a stiff helix antenna, both of which are essentially unprotected and may accidentally be broken in unfortunate situations, where the antenna is exposed to strong external bending forces.

Figure 3:
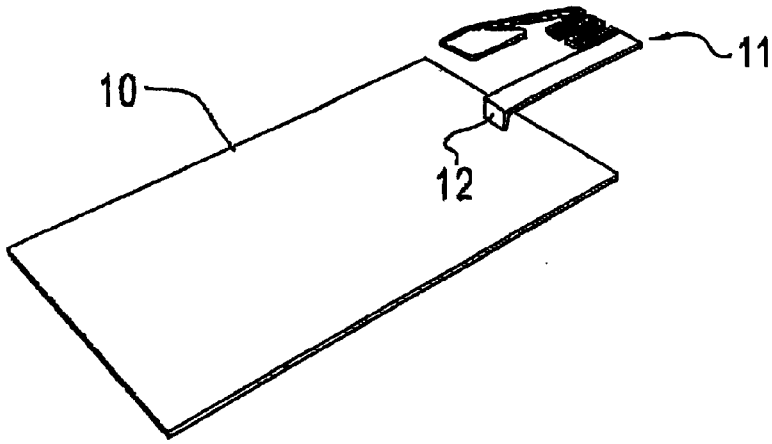
FIG. 3 is a schematic perspective view of a multi-band antenna according to a preferred embodiment of the invention, connected to radio circuitry on a printed circuit board in the mobile telephone of FIGS. 1 and 2.
Figure 4:
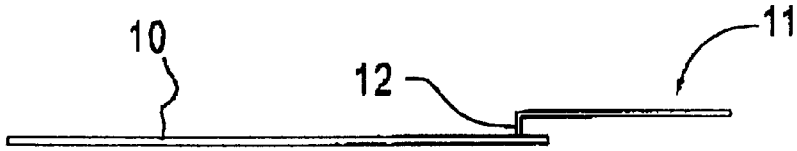
FIG. 4 is a side view corresponding to FIG. 3.
Figure 5:
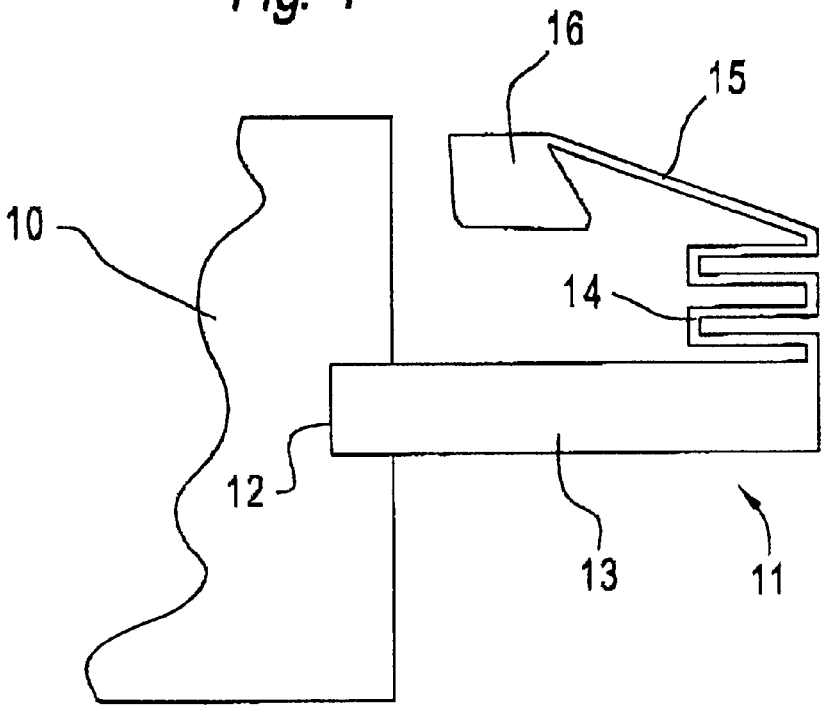
FIG. 5 is an enlarged top view of the multi-band antenna indicated in FIGS. 3 and 4.

FIGS. 3–5 illustrate an antenna 11 according to a preferred embodiment of the invention. The antenna 11 consists of an integral pattern of electrically conductive material, preferably copper or another suitable metal with very good conductive properties. The conductive material is very thin, preferably in the order of 30 $\mu$m; consequently the thickness of the antenna 11 has been highly exaggerated in the drawings for illustrating purposes only. As shown in FIGS. 3–5, the antenna 11 comprises an initial part 12, that is bent with respect to the other parts of the antenna 11 and serves as an electrical interface to radio circuitry, which are provided on a printed circuit board 10 in the mobile telephone 1. In the preferred embodiment, the entire antenna pattern 11, with the exception of the initial part 12, is provided in a single plane, which is arranged at a vertical distance of the order of 5–10 mm with respect to the underlying printed circuit board 10. The plane of the antenna pattern 11 may either be parallel to the printed circuit board 10, as shown in the drawings, or alternatively be arranged at an angle, such as 15°, to the printed circuit board 10, depending on the actual implementation, the design of the flexible coating 3 with respect to the apparatus housing of the mobile telephone 1, etc.

The antenna pattern 11 comprises a first portion 13, which acts as a geometrically wide feeding strip and is consequently adapted to communicate electrically with the radio circuitry on the printed circuit board 10 through the bent initial part 12. The wide feeding strip 13 has a linear extension, as shown in the FIGS. 3–5. At a second end of the feeding strip 13, opposite the initial part 12, a second portion 14 of the conductive material is provided. The second portion 14 has the form of a very narrow twisted strip with a non-linear extension, or more specifically a meander-shape in the preferred embodiment according to FIGS. 3–5. The width of the twisted strip 14 is considerably narrower than the width of the wide feeding strip 13.

A third portion 16 is provided as a topload at the free end of the antenna pattern 11 in the form of an almost square-like area, which is considerably wider than the very thin twisted strip 14. Between the twisted strip 14 and the topload 16 a fourth essentially linear intermediate portion 15 is provided, having an essentially linear extension and a width, which is equal to the width of the thin twisted strip 14.

The antenna pattern 11 is attached to a flat support element, preferably in the form of a dielectric kapton film. In the preferred embodiment, a kapton film referred to as R/Flex 2005 K is used, having a width of 70 $\mu$m and being commercially available from Rogers Corporation, Circuit Materials Division, 100 N, Dobson Road, Chandler, AZ-85224, USA. Alternatively, a similar dielectric film may be used, for instance provided by Freudenberg, Mētec GmbH & KG, Headquarters, D-69465 Weinheim/Bergstrasse, or any other suitable commercially available dielectric film.

The pattern 11 of conductive material and the kapton film together form a Flex film.

Figure 6:
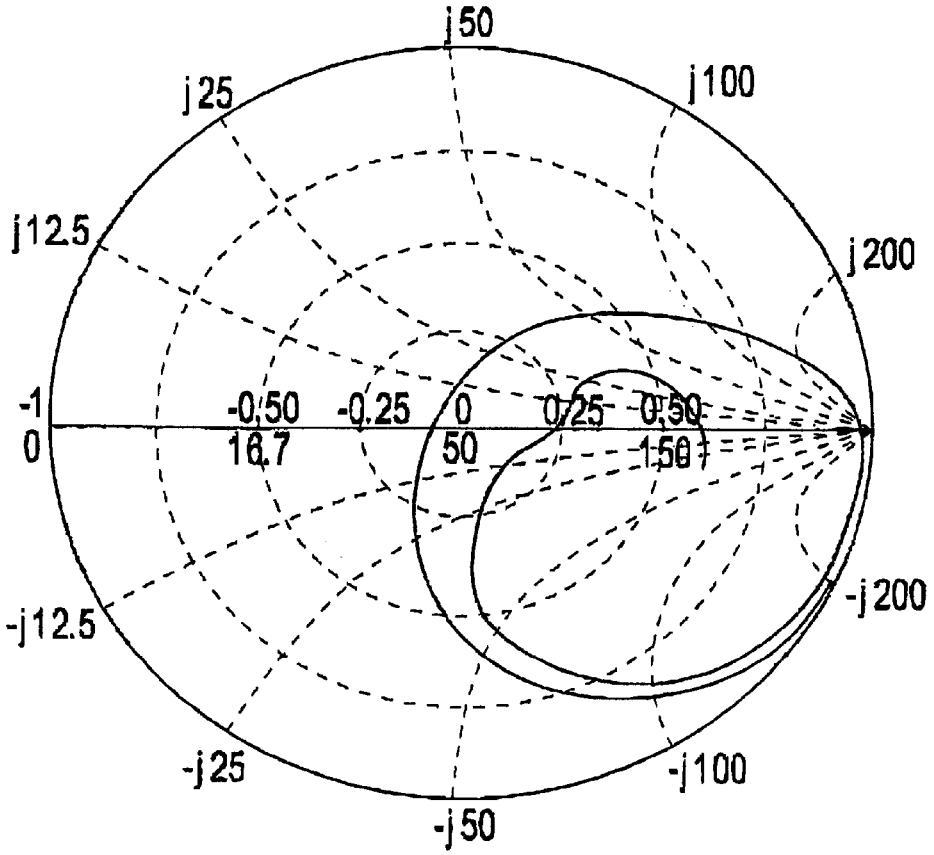
FIG. 6 is a Smith-diagram to illustrate the simulated performance of the antenna according to the preferred embodiment.

The antenna disclosed in FIGS. 3–5 is a small and flexible antenna, which provides excellent resonance performance in several different frequency bands. This is illustrated by a Smith diagram in FIG. 6 and a return loss diagram in FIG. 7. Both of these diagrams are the result of simulations rather than measurements made on a real antenna. Therefore, particularly as regards the return loss diagram of FIG. 7, the resonance frequency ranges thereof dc not correspond exactly to the desired frequency ranges in real applications.

Figure 7:
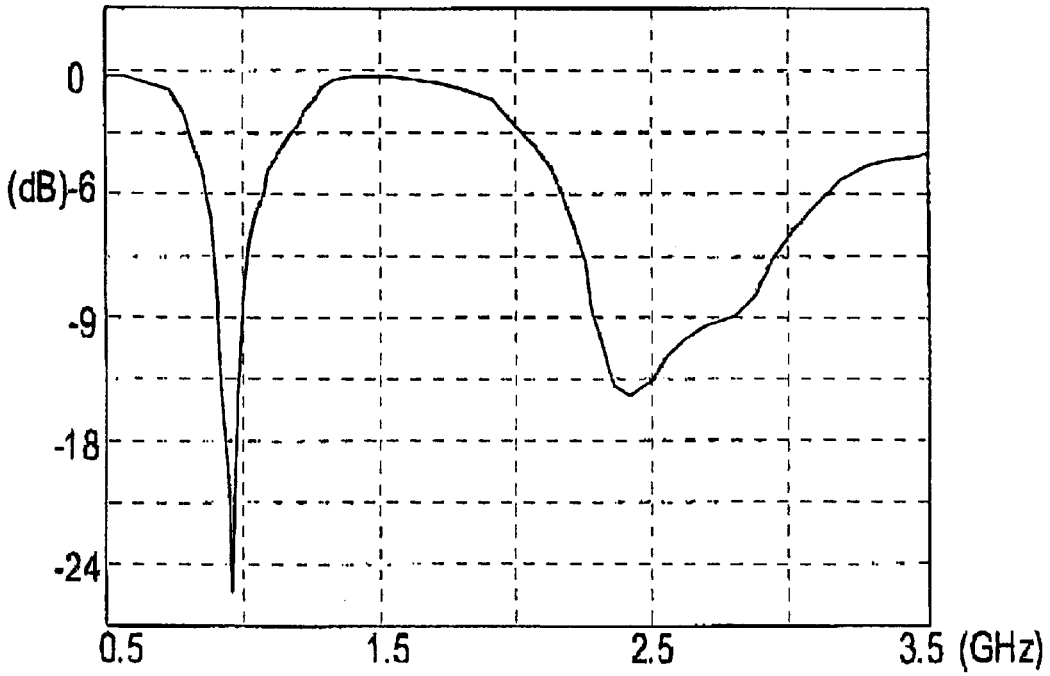
FIG. 7 is a return loss diagram to illustrate the simulated performance of the preferred embodiment.

As is well-known to a man skilled in the art, a return loss diagram illustrates the frequencies at which an antenna is working, i.e. where the antenna is resonating. The return loss diagram presented in FIG. 7 represents the return loss in dB as a function of frequency. The lower Db values in a return loss diagram, the better. Moreover, the broader resonance, the better. In a return loss diagram, a resonance is an area, within which the return loss is low (a high negative value in dB). In the diagram of FIG. 7, this looks like a steep and deep cavity. Return loss is a parameter indicating how much energy the antenna will reflect or accept at a given frequency.

Return loss (RL) may be defined as:

$$RL \times -20 \cdot \lg[\mathrm{abs}(\Gamma)],$$

where $\Gamma$= (reflected voltage or current)/(incident voltage or current).

A similar type of diagram is SWR (Standing Wave Ratio). SWR is defined as the ratio between maximum voltage or current and minimum voltage or current.

Smith diagrams are a familiar tool within the art and are thoroughly described in the literature, for instance in chapters 2.2 and 2.3 of "Microwave Transistor Amplifiers, Analysis and Design", by Guillermo Gonzales, Ph.D., Prentice-Hall, Inc., Englewood Cliffs, N.J. 07632, USA, ISBN 0-13-581646-7. Therefore, the nature of Smith diagrams are not penetrated in any detail herein. However, briefly speaking, the Smith diagrams in this specification illustrates the input impedance of the antenna: $Z=R+jX$, where R represents the resistance and X represents the reactance. If the reactance $X>0$, it is referred to as inductance, otherwise capacitance.

In the Smith diagram the curved graph represents different frequencies in an increasing sequence. The horizontal axis of the diagram represents pure resistance (no reactance). Of particular importance is the point at 50 Ω, which normally represents an ideal input impedance. The upper hemisphere of the Smith diagram is referred to as the inductive hemisphere. Correspondingly, the lower hemisphere is referred to as the capacitive hemisphere.

Figure 8:
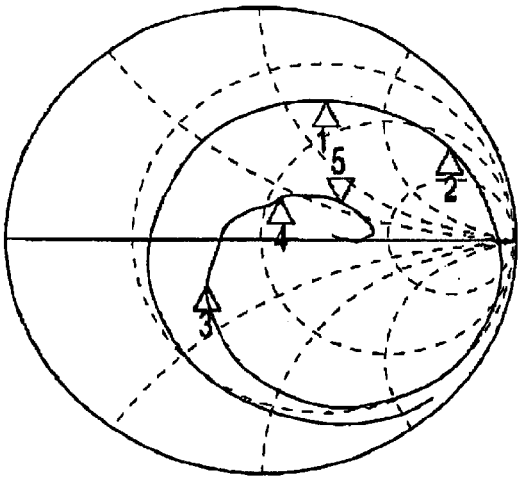
FIG. 8 is a Smith diagram, representing antenna performance measured under real-life conditions, for the preferred embodiment of the antenna.
Figure 9:
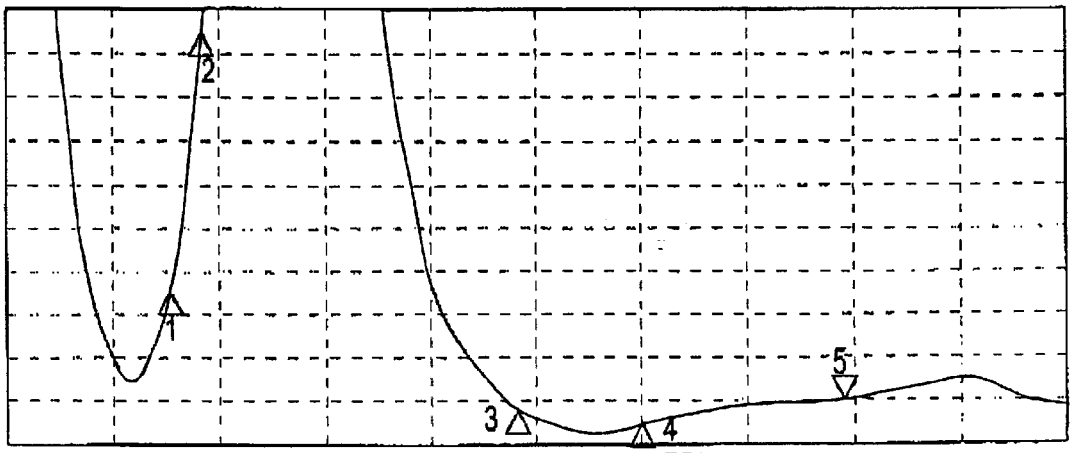
FIG. 9 is an SWR diagram, representing antenna performance measured under real-life conditions, for the preferred embodiment of the antenna.

FIG. 8 illustrates a second Smith diagram for the preferred embodiment shown in FIGS. 3–5. In contrast to FIG. 6, the Smith diagram of FIG. 8 represents real measurement data for an antenna according to the preferred embodiment when held in a talking position close to a user. Correspondingly, FIG. 9 illustrates a "real-life" SWR diagram, which in contrast to FIG. 7 represents real measured data. In the diagrams of FIGS. 8 and 9, the values at five different frequencies are indicated as markers 1–5. The antenna according to the preferred embodiment exhibits excellent performance in a lower frequency located slightly below the GSM band between 890 and 960 MHz. However, tests have proven that the antenna may easily be tuned to have its lower frequency band at exactly the GSM band.

Moreover, the SWR diagram exhibits a very broad resonance cavity in higher frequency bands, covering important frequency bands at 1800 and 1900 MHz, as well as, in fact, even frequency bands at 2.1 GHz and 2.4 GHz. Conclusively, not only does the antenna 11 according to the preferred embodiment provide excellent performance in a low frequency band around 900 MHz (e.g. for GSM) but also in four different high frequency bands around 1800 MHz (e.g. DCS or GSM 1800 at 1710–1880 MHz), 1900 MHz (e.g. GSM 1900 at 1850–1990 MHz), 2100 MHz (e.g. UMTS, "Universal Mobile Telephone System") and 2400 MHz (e.g. Bluetooth, ISM—"Industrial, Scientific and Medical"). In other words, the inventive antenna is a multi-band antenna with a very broad high frequency band coverage, which will be referred to further below.

Studies and experiments have proven that the geometrically wide feeding strip 13 generates the broad high band resonance indicated in the diagrams. A standing wave is obtained with a high impedance around the second end (opposite the feeding end 12) of the feeding strip 13. The whole antenna length, including the feeding strip 13, the narrow twisted strip 14, the intermediate straight portion 15 and the topload 16, jointly provide the good performance for the low frequency band.

It has been found that the distance between the feeding strip 13 and the topload 16 is of considerable tuning importance, as well as the way in which the narrow strip 14 is twisted. Moreover, the twisting of the narrow strip 14 adds inductive impedance to the antenna structure 11. This provides an impedance transformation in that the narrow twisted strip 14 is considered, at high frequencies, to be of a very high impedance but of a desired low impedance, around 50 Ω, in the low frequency band. Therefore, the connection between the wide feeding strip 13 and the narrow twisted strip 14 operates as a kind of impedance transformer.

An important aspect of the antenna according to the invention is that it does not need a well-defined electrical ground in contrast to some prior art antennas.

Moreover, it has been discovered that the bandwidth of the high frequency band(s) can be controlled by the width of the wide feeding strip 13. For the preferred embodiment, starting from a width of about 3 mm, the bandwidth of the high frequency band(s) increases with increasing width of the wide feeding strip 13. However, at a width of about 15 mm, the bandwidth of the high frequency band(s) does no longer increase substantially, even if the width of the wide feeding strip 13 is increased further. Therefore, for the preferred embodiment a width of about 3–15 mm is preferred for the wide feeding strip 13.

Figure 10:
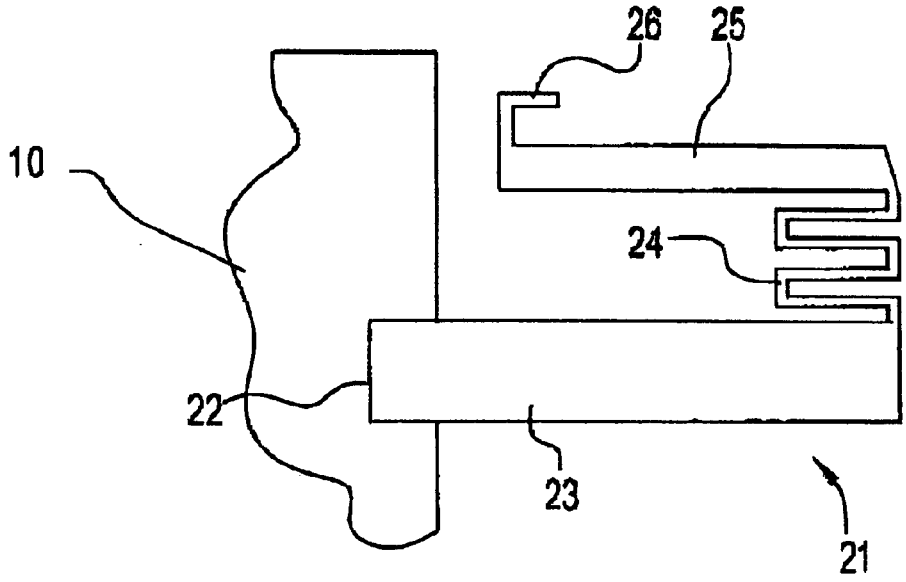
FIG. 10 illustrates a first alternative embodiment of the antenna according to the invention.

FIG. 10 illustrates a first alternative embodiment 21 of the antenna. In FIG. 10, the initial portion 22 of the wide feeding strip 23 serves as a connection interface to the printed circuit board, just as in the preferred embodiment of FIGS. 3–5. Moreover, the embodiment 21 of FIG. 10 has a meander-shaped narrow second portion 24, having properties similar to the ones described above for the preferred embodiment. However, at the end of the narrow twisted strip 24 an essentially rectangular broader strip 25 is provided, which finally ends in a thin short angled portion 26.

Figure 11:
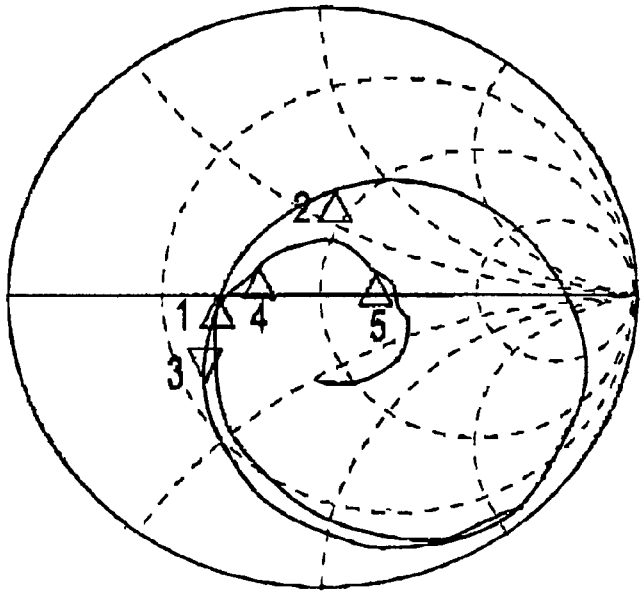
FIGS. 11 and 12 are real-life Smith and SWR diagrams, respectively, for the first alternative embodiment shown in FIG. 10.
Figure 12:
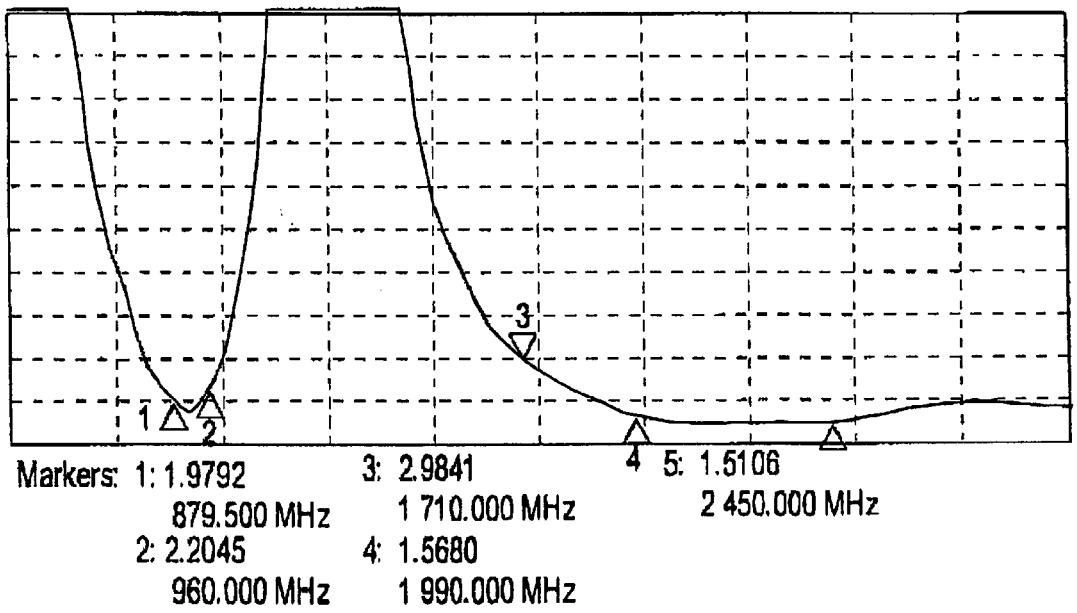

The performance of the embodiment of FIG. 10 is indicated by a Smith diagram in FIG. 11 and a corresponding SWR diagram in FIG. 12, both of which represent real measurement data for the antenna 21 in a talking position. It appears from FIGS. 11 and 12 that also the alternative embodiment of FIG. 10 exhibits excellent multi-band performance not only in a low frequency band at about 900 MHz but also in several high frequency bands at 1800 MHz, 1900 MHz and 2400 MHz.

Figure 13:
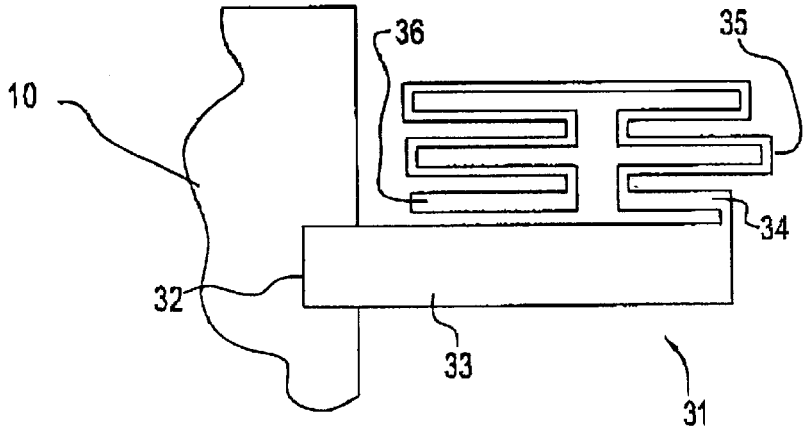
FIG. 13 is a second alternative embodiment of the antenna according to the invention.
Figure 14:
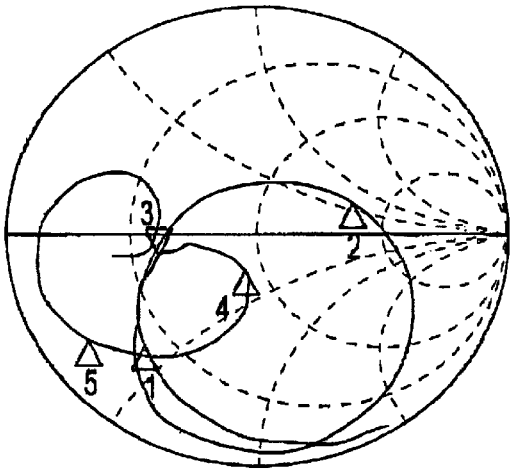
FIGS. 14 and 15 are real-life Smith and SWR diagrams, respectively, for the second alternative embodiment shown in FIG. 13.
Figure 15:
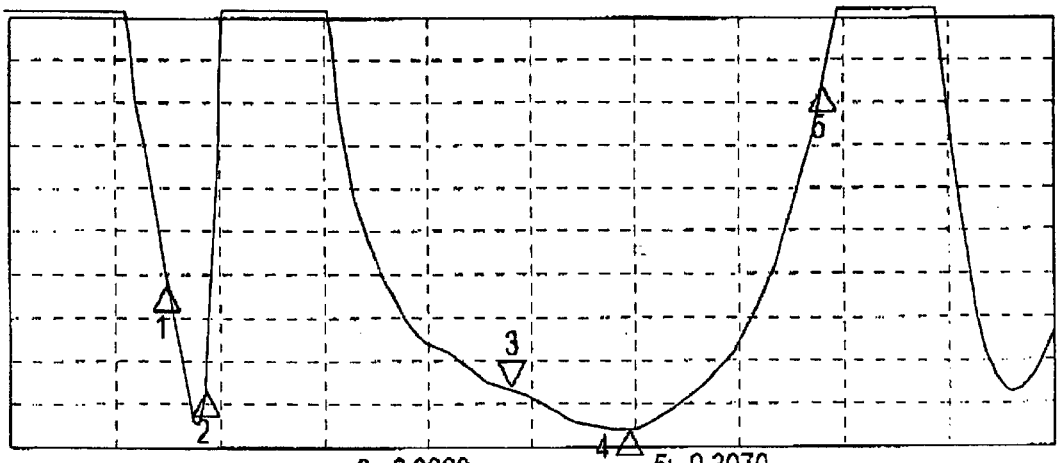

FIG. 13 illustrates a second alternative embodiment 31 of the antenna according to the invention. The initial part 32 corresponds to the part 12 in the preferred embodiment of FIGS. 3–5 and serves as a connection interface to the printed circuit board 10. The wide feeding strip 33 is essentially similar to the ones disclosed above for the embodiments of FIGS. 3–5 and FIG. 10, respectively. Between the narrow twisted strip 35 and the wide feeding strip 33, however, there is provided a short intermediate portion 34 having a linear extension. Moreover, the twisted strip 35 has a different layout than the ones in the previous embodiment, as appears from FIG. 13. Finally, the narrow twisted strip 35 ends with a slightly wider straight strip 36. The performance of the embodiment shown in FIG. 13 appears from a Smith diagram in FIG. 14 and a corresponding SWR diagram in FIG. 15, both of which represent data from real measurements with the antenna in its talking position.

Figure 16:
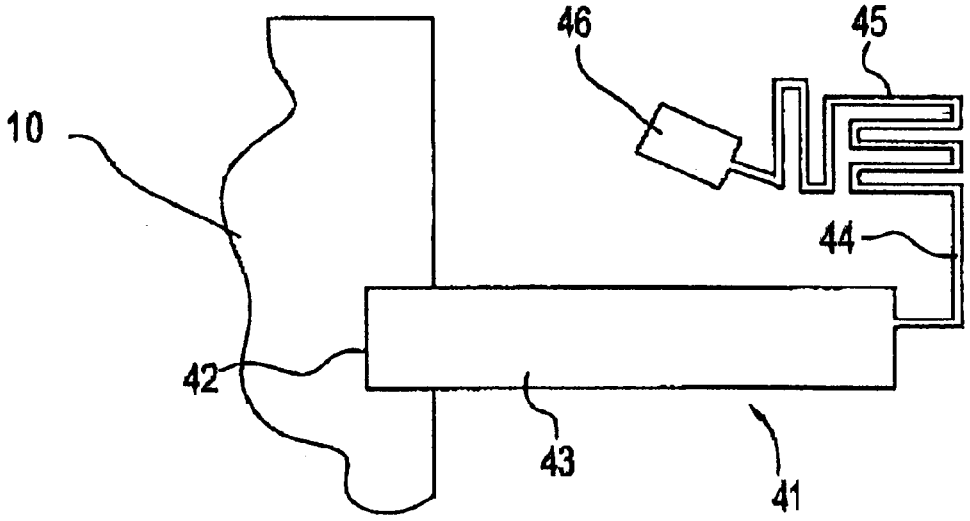
FIG. 16 is a third alternative embodiment of the antenna according to the invention.

A third alternative embodiment 41 of the antenna is illustrated in FIG. 16. In this embodiment, the initial part 42, the wide feeding strip 43 and the printed circuit board 10 are all essentially similar to the previously described embodiments. Between a narrow twisted strip 45 and the wide feeding strip 43 another narrow strip 44 is provided, which is longer than the intermediate strip 34 in the embodiment of FIG. 13 and has the same width as the succeeding twisted strip 45. The layout of the twisted strip 45 differs from the previous embodiments. After the twisted strip 45 a topload 45 is provided, having essentially similar purposes as the topload 16 in the preferred embodiment of FIGS. 3–5.

Figure 17:
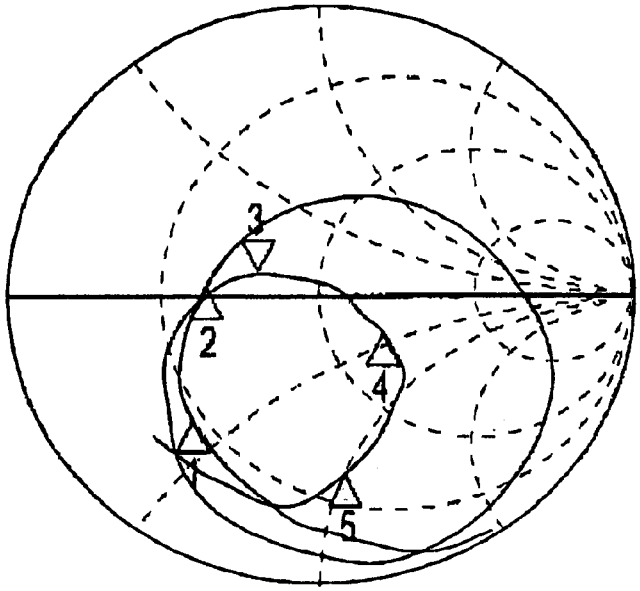
FIGS. 17 and 18 are real-life Smith and SWR diagrams respectively, for the third alternative embodiment shown in FIG. 16.
Figure 18:
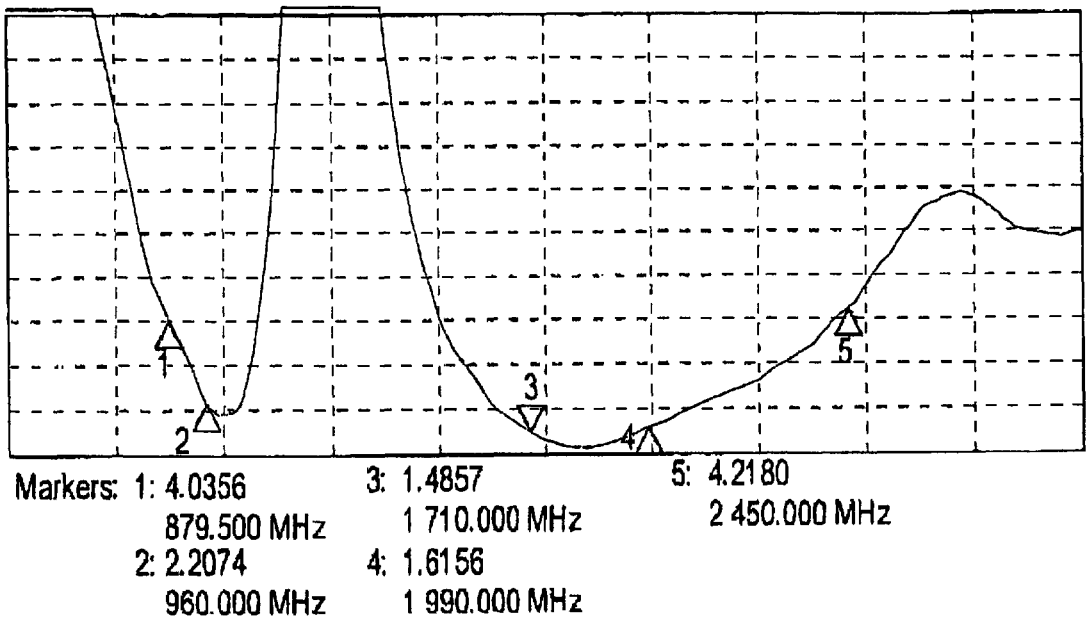

The performance of the third alternative embodiment shown in FIG. 16 appears in a Smith diagram in FIG. 17 and a corresponding SWR diagram in FIG. 18, both of which represent real-life measurement data with the antenna 41 in a talking position.

An important advantage of the present invention is that it allows a very low manufacturing cost. Another important advantage is that it allows great flexibility, since it does not contain any mechanically sensitive parts. Therefore, it may advantageously be embedded, together with its flexible dielectric support element (kapton film), in a coating 3 of plastic or rubber, as indicated in FIGS. 1 and 2.

Consequently, the presently invention also involves a portable telecommunication apparatus, such as a mobile telephone 1, having a flexible antenna 11/21/31/41 and a surrounding flexible coating 3 projecting from its apparatus housing, as shown in FIGS. 1 and 2. Not only does such a portable telecommunication apparatus allow exciting design opportunities; it also makes the portable telecommunication apparatus considerably more robust and safer from accidental mechanical damage to the antenna, thanks to its flexibility.

The present invention has been described above with reference to a preferred embodiment together with three alternatives. However, many other embodiments not disclosed herein are equally possible within the scope of the invention, as defined by the appended independent patent claims. Particularly as regards the geometrical dimensioning of the pattern of conductive material, which makes up the antenna, the various dimensions will all have to be carefully selected depending on the actual application. Moreover, the frequency bands in which the antenna is operative may also be greatly varied depending on actual application. Therefore, the antenna pattern has to be tuned for the actual application, which, however, is believed to be nothing but mere routine activity for a skilled person and which therefore does not require any further explanations herein.

What is claimed is:

1. A multi-band antenna for use in a portable telecommunication apparatus, the antenna comprising a pattern of conductive material and being adapted to operate in at least two frequency bands, characterized by:

a first portion of conductive material having a width for providing broad high band resonance, and having a first end for connection to radio circuitry in the portable telecommunication apparatus, and a second end, a second portion of conductive material having a first end connected to the second end of the first portion, wherein the second portion has a non-linear extension and is narrower than the first portion, and a third portion of conductive material, connected to the second portion wherein the third portion is wider than the second portion and provides capacitive.

2. An antenna according to claim 1, further comprising a fourth portion of conductive material between the second and third portions, wherein the fourth portion has the same width as the second portion and has a essentially linear extension.

3. An antenna according to claim 1, wherein the second portion of conductive material has a meander shape.

4. An antenna according to claim 1, wherein there is a substantial change in width between the first portion and the second portion of conductive material.

5. An antenna according to claim 1, wherein essentially the entire pattern of thin conductive material is arranged in one plane.

6. An antenna according to claim 5, wherein the radio circuitry in the portable telecommunication apparatus is provided on a printed circuit board and wherein an initial part of the first portion of conductive material is arranged at an angle with respect to an antenna plane comprising a remainder of the first portion and the second and third portions of the antenna pattern and wherein the antenna plane is at an orthogonal distance from the printed circuit board.

7. An antenna according to claim 1, wherein the pattern of conductive material has a thickness in the order 30 $\mu$m.

8. An antenna according to claim 1, wherein the conductive material is copper.

9. An antenna according to claim 1, wherein the pattern of conductive material is provided on a flat dielectric support element.

10. An antenna according to claim 9, wherein the flat dielectric support element is a dielectric film.

11. An antenna according to claim 9, wherein the pattern of conductive material and the flat dielectric support form a flex film.

12. An antenna according to claim 6, wherein an electrical contact interface between the first end of the first portion and the radio circuitry on the printed circuit board is as wide as the width of the first portion.

13. An antenna according to claim 6, provided with a coating of plastic or rubber.

14. A multi-band antenna for use in a portable telecommunication apparatus, the antenna comprising a pattern of conductive material and being adapted to operate in at least two frequency bands, characterized by:

a first portion of conductive material having a first end to be connected to radio circuitry in the portable telecommunication apparatus, and a second end, a second portion of conductive material having a first end connected to the second end of the first portion, wherein the second portion has a non-linear extension and is narrower than the first portion, and a third portion of conductive material, connected to the second portion, wherein the third portion is wider than the second portion and provides capacitive loading of the antenna, wherein the radio circuitry in the portable telecommunication apparatus is provided on a printed circuit board and essentially the entire pattern of thin conductive material is arranged in one plane at a vertical distance that is of the order of 5–10 mm from the printed circuit board.

15. A multi-band antenna for use in a portable telecommunication apparatus, the antenna comprising a pattern of conductive material and being adapted to operate in at least two frequency bands, characterized by:

a first portion of conductive material having a first end to be connected to radio circuitry in the portable telecommunication apparatus, and a second end, a second portion of conductive material having a first end connected to the second end of the first portion, wherein the second portion has a non-linear extension and is narrower than the first portion, and a third portion of conductive material, connected to the second portion, wherein the third portion is wider than the second portion and provides capacitive loading of the antenna, wherein the antenna is adapted to operate in at least three frequency bands.

16. An antenna according to claim 15, wherein the antenna is adapted to operate in a first frequency band at about 900 MHz, a second frequency band at about 1800 MHz and a third frequency band at about 1900 MHz.

17. An antenna according to claim 15, wherein the antenna is adapted to operate in frequency bands at about 2100 and 2400 MHz.

18. An antenna according to claim 15, wherein the first portion of conductive material has a width of about 3–15 mm.

* * * * *